US006604949B2

(12) United States Patent
Oldfield

(10) Patent No.: US 6,604,949 B2
(45) Date of Patent: Aug. 12, 2003

(54) HIGH FREQUENCY HERMETIC CONNECTOR WITH GROUND LIP

(75) Inventor: William Oldfield, Redwood City, CA (US)

(73) Assignee: Anritsu Company, Morgan Hill, CA (US)

( * ) Notice: Subject to any disclaimer, the term of this patent is extended or adjusted under 35 U.S.C. 154(b) by 0 days.

(21) Appl. No.: 09/799,942

(22) Filed: Mar. 6, 2001

(65) Prior Publication Data

US 2002/0127892 A1 Sep. 12, 2002

(51) Int. Cl.[7] ..... H01R 12/00
(52) U.S. Cl. ..... 439/63; 333/260
(58) Field of Search ..... 333/260; 439/63

(56) References Cited

U.S. PATENT DOCUMENTS 4,259,684 A 3/1981 Dean et al. ..... 357/74
4,724,409 A 2/1988 Lehman ..... 333/260
5,508,666 A * 4/1996 Nguyen ..... 333/33
5,576,675 A 11/1996 Oldfield ..... 333/260
5,696,474 A * 12/1997 Spivey et al. ..... 333/245
5,856,768 A * 1/1999 Hey-Shipton et al. .... 333/99 S
5,959,514 A 9/1999 Smith et al. ..... 333/260
6,154,103 A * 11/2000 Scharen et al. ..... 333/99 S

OTHER PUBLICATIONS

"Why MMICs!", downloaded from http://www–unix.ecs.u-mass.edu/~jackson/mmicuse.html on Oct. 2, 2000.

* cited by examiner

*Primary Examiner*—Renee Luebke
*Assistant Examiner*—Ann McCamey
(74) *Attorney, Agent, or Firm*—Fliesler Dubb Meyer & Lovejoy, LLP

(57) ABSTRACT

The present invention incorporates a hermetic glass bead 206 and a grounding lip 208 into an outer conductor insert 216 to form a microwave coax connector 201. The glass bead 206 forms both the hermetic seal and the support for the coax center conductor pin 214. The outer conductor insert 216 of the coax connector 201 includes the ground lip 208 to provide a short ground path for the connection to a microstrip substrate 10 provided on a carrier 12 in a housing 2. The coax connector 201 is soldered into a cavity 235 in the housing 2 to assure a short ground path between the coax connector 201 and the carrier 12. There is no need for soldering a separate glass bead into the housing 2, which at these high frequencies, is very difficult due to the small size of the glass bead.

6 Claims, 3 Drawing Sheets

HIGH FREQUENCY HERMETIC CONNECTOR WITH GROUND LIP

FIELD OF THE INVENTION

The present invention relates generally to microwave connectors. More particularly, the present invention relates to a microwave connector that connects to a microstrip circuit on a carrier and uses a glass bead for hermetic sealing.

BACKGROUND OF THE INVENTION

FIG. 1 illustrates an assembly of typical connector components 1 along with a housing 2 containing a microstrip substrate 10 supported by a carrier 12. FIG. 2 shows more details of the connector components 1 and housing 2. FIG. 2 also illustrates a typical sparkplug type coaxial connector 18 and connector components 1 assembly. Components carried over from FIG. 1 to FIG. 2 are similarly labeled, as will be carried over in subsequent drawings.

The sparkplug type connector 18 includes a center conductor 16 with a female type pin which mates with a male pin 14 supported by the housing 2. The center conductor 16 of the connector 18 is supported by a glass bead 20. Surrounding the glass bead 20 is a metal cylindrical outer conducting shell 19 which is threaded like a sparkplug for insertion into a similarly threaded hole 22 in the wall of the package housing 2.

The center conductor 14 supported by the housing 2 is also supported by the glass bead 6 which is provided in a opening 22 of the housing. The glass bead 6 in the housing is further hermetically sealed using solder provided in the access hole 26 shown. The center conductor 14 extends a short distance onto the microstrip substrate 10.

The microstrip substrate 10 typically contains MMICs for mounting on the carrier 12. The carrier 12 is a thin piece of metal, typically ½ to 1 mm thick, which provides the ground for the microstrip substrate 10, and hence the MMICs on the microstrip substrate 10. Carriers which can provide grounding at high frequencies become more desirable with the increasing availability of MMIC subsystems. If a number of MMICs are mounted directly onto a housing and one of them fails, the entire assembly must be discarded, as it is generally impossible to remove a fragile MMIC after it has been mounted by soldering directly to the housing without destroying other MMICs in the vicinity. However, a carrier can be mechanically placed in and removed from the housing without destroying the circuit components mounted on it.

Conventionally, the connector components 1 provide for a coax to microstrip transition including electrical transition and impedance matching between the coaxial transmission line of the coaxial connector and the microstrip transmission line connected to the MMICs. As shown in FIG. 3, the compensation can include an air gap 40 between the support bead 6 and housing 2, as well as a controlled air gap 42 between the microstrip substrate and outer conductor formed by the housing 2. Typical dimensions for the compensation gaps are shown in FIG. 3 with a center conductor of 0.009" and a center conductor pin 14 extending beyond the outer conductor 0.010" onto the microstrip substrate 10.

As microwave components and subsystems go higher and higher in frequency, the importance of the coax connector becomes more critical. With the advent of multi-function MMIC chips, two factors normally not required at lower frequencies become required at higher frequencies. First hermicity, and second very short ground paths.

Hermicity in microwave packages is traditionally achieved by use of the glass beads. The beads themselves are hermetic and when soldered correctly into a package, the package becomes hermetic. For microwave applications, the areas surrounding the glass bead are critical for good RF performance. The tight tolerance compensation steps become difficult to achieve as the glass-beads get smaller in size at higher frequencies. The process of soldering the glass bead into the housing also becomes more critical and difficult as the beads shrink in size.

With MMICs built on carriers which are mounted on a housing, a long ground path gap 15 typically exists between the carrier 12 and the outer conductor 28 of the coaxial connector 1 joining the microstrip. The long ground path 15 results in poor performance of the coax to microstrip interface. FIG. 3 illustrates the typical performance of the connector connected to microstrip shown in FIGS. 1 and 2.

SUMMARY OF THE INVENTION

In accordance with the present invention, a hermetic glass bead and a grounding lip are incorporated into the connector, effectively eliminating the poor performance due to a long ground path. The glass bead forms both the hermetic seal and the support for the coax center conductor pin. The ground lip is in the required location to provide a short ground path for the connecting microstrip substrate. When the connector and the housing are coupled together, the assembly allows for a signal to efficiently pass through the center conductor pin to the microstrip line with an adequate ground. The user merely has to solder the connector into a very simple hole in the package. There is no need for soldering the glass bead into the connector, which at high frequencies is very difficult due to the small size of the glass bead. All compensation steps can further be incorporated into the connector.

BRIEF DESCRIPTION OF THE DRAWINGS

The invention will be described with respect to particular embodiments thereof, and reference will be made to the drawings, in which.

DETAILED DESCRIPTION

Figure 1:
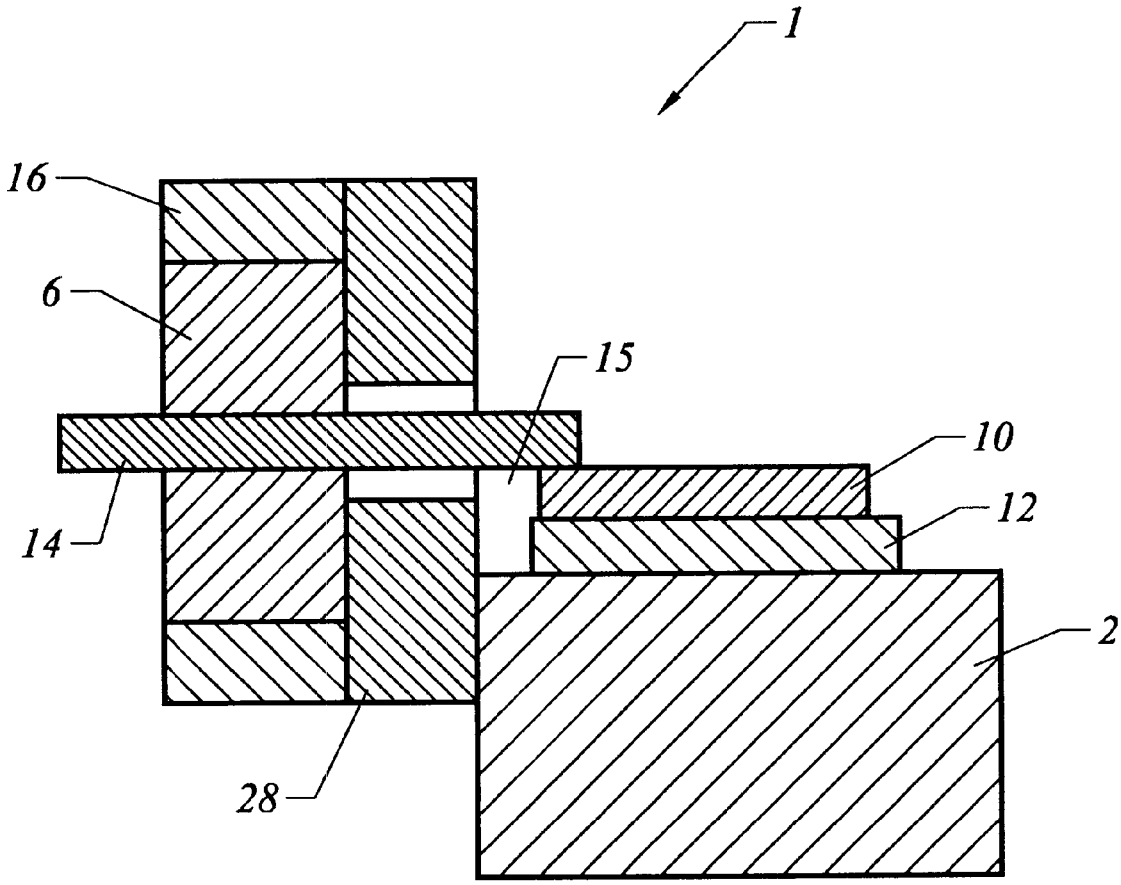
FIG. 1 (Prior Art)
FIG. 1 is a block diagram of a typical carrier mounted in a housing.
Figure 2:
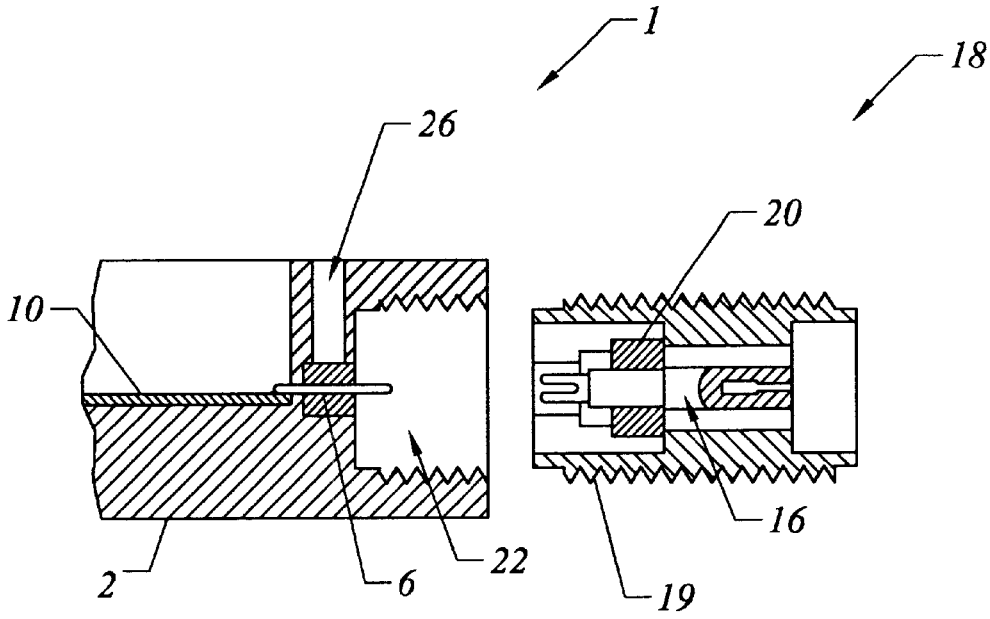
FIG. 2 (Prior Art)
FIG. 2 is a partial cross-sectional side view of a typical glass bead and connector assembly.
Figure 3:
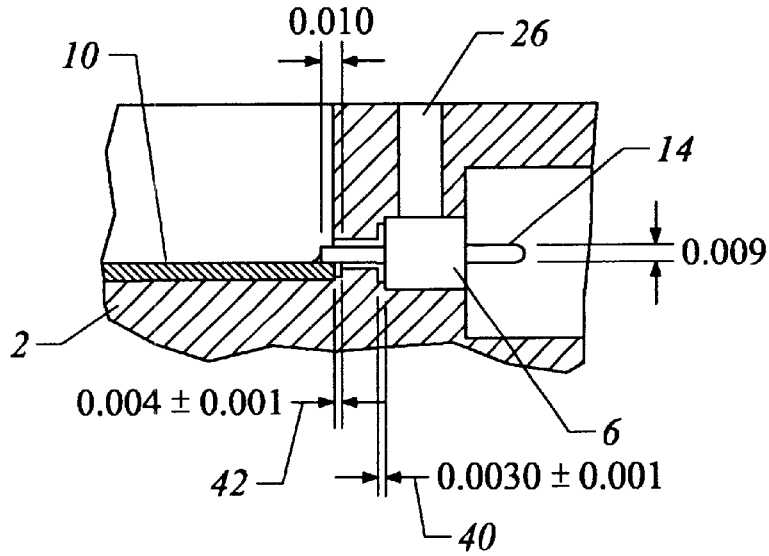
FIG. 3 (Prior Art)
FIG. 3 is a partial cross-sectional side view showing typical compensation steps.
Figure 4:
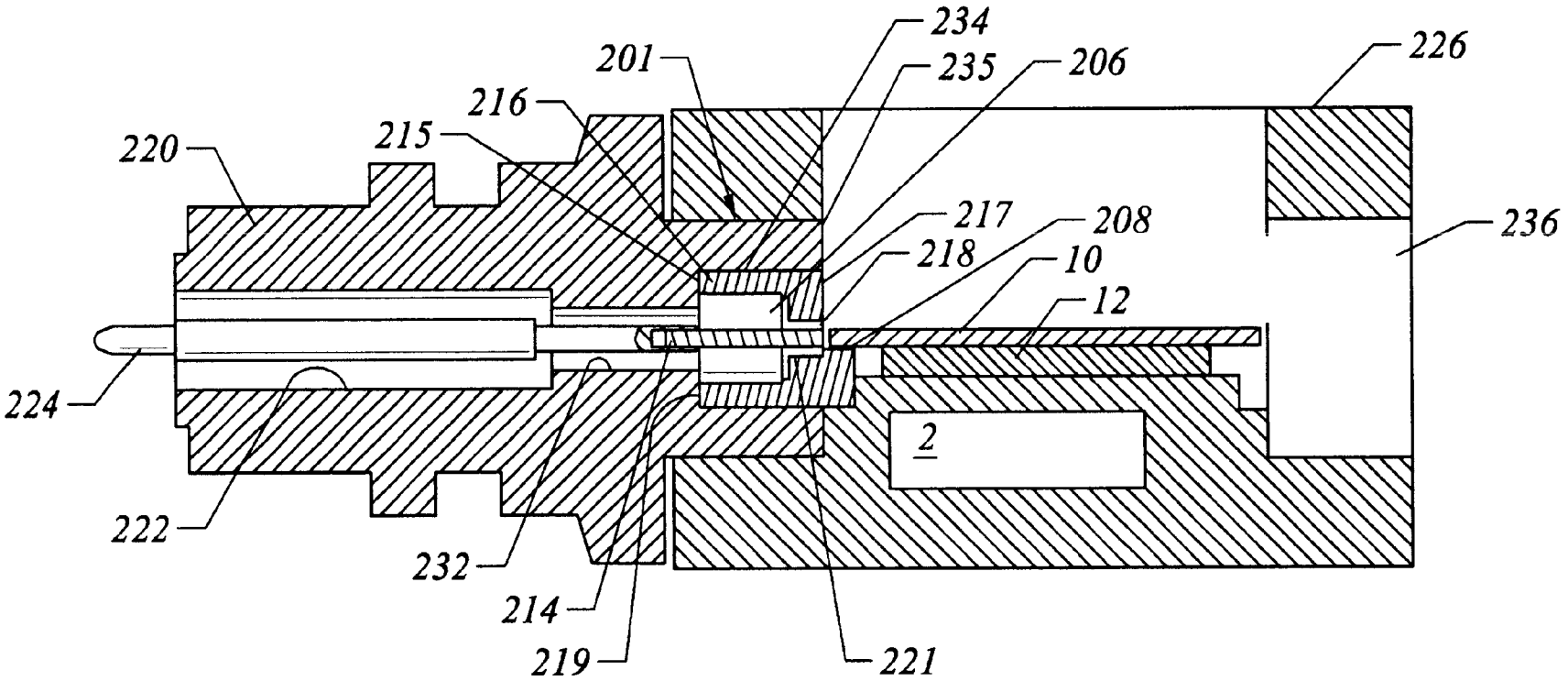
FIG. 4 is a partial cross-sectional side view of a system in accordance with the present invention.

FIG. 4 illustrates a connector assembly in accordance with the present invention as connected to a housing 2 containing a microstrip substrate 10 on a carrier 12. Connector 201 includes an outer conductor insert 216 with an integrated ground lip 208. The outer conductor insert 216 supports a glass bead 206 and a center conductor pin 214. The outer conductor insert 216 has a cylindrical first end 215 and a second end 217. The cylindrical first end 215 includes a first bore 218 and a first counter bore 219. The glass bead 206 is located within the first counter bore 219 of the outer conductor insert 216, such that the glass bead 206 supports the center conductor pin 214. Additionally, the glass bead 206 allows for the formation of a hermetic seal around the center conductor pin 214. The hermetic seal is allowed to form by soldering through a second bore (not shown) in the first end 215 of the outer conductor insert 216.

The outer conductor insert 216 ground lip 208 is formed by an extension of the second end 217 of the outer conductor insert 216. The ground lip 208 forms a half cylinder shape. It may be appreciated by others skilled in the art that ground lip 208 may also form other shapes. The ground lip 208 has at least one flat surface facing towards the center conductor pin 214 so that the flat surface can provide a transition to the microstrip 10 to provide a ground.

The outer conductor insert 216 further includes a second counter bore 221 less in diameter than the first counter bore 219. The second counter bore 221 provides an impedance compensation step between the first bore 218 and the first counter bore 219. Other impedance compensation steps might be used similar to those shown in FIG. 4. This additional compensation step may not be necessary depending on user design requirements.

The center conductor pin 214 preferably protrudes through the first end 215 and the second end 217 of the outer conductor insert 216. The connector 201 may be designed such that the center conductor pin 214 contacts the microstrip substrate 10. The center conductor pin 214 may contact the microstrip substrate 10 directly to make electrical contact, be soldered to the microstrip substrate, or be connected by a ribbon bond. It may be appreciated by one skilled in the art that the center conductor pin 214 might not extend onto the microstrip substrate 10, as shown in FIG. 4 and be connected to the microstrip substrate 10 using a ribbon bond.

As further illustrated by FIG. 4, the remainder of the connector 201 includes a connector outer conductor 220. The connector outer conductor has a first bore 222 with a first diameter and a second bore 232 with a diameter slightly smaller than the first bore 222. Inside the first and second bores 222 and 232 is a second outer conductor pin 224. The pin 224 has an outer diameter which changes with the different diameters of the first and second bores 222 and 232. The different diameters of the second conductor pin 224 and bores 222 and 232 provide a step for impedance matching to the diameter of pin 214 provided in the glass bead 206. Although one impedance matching step is shown, more or less steps may be used depending on specific design requirements. The connector outer conductor 220 includes a cavity 234 for receiving the outer conductor insert 216.

The housing 2 contains a cavity 235 for receiving an extension of the connector outer conductor 220. To ensure a good connection between the connector outer conductor 220 and the housing 2, the connector outer conductor 220 is attached to the housing 2. For example, the extension of the outer conductor 220 may be soldered into the cavity 235 of the housing 2 or connected to the housing 2 by bolts. The housing further contains a cavity 236 similar to 235 in the housing portion 226, although no connector is shown attached. An alignment fixture which fits into the housing includes an opening for the ground lip 208 to insure a correct orientation of the ground lip 208 when the connector 201 is inserted into the housing 2.

Although the present invention has been described above with particularity, this was merely to teach one of ordinary skill in the art how to make and use the invention. Many additional modifications will fall within the scope of the invention, as that scope is defined by the claims which follow.

What is claimed is:

1. A connector assembly comprising:

a coaxial connector;

a microstrip substrate;

a housing supporting the microstrip substrate attached to a carrier, the housing including an opening for insertion of the coaxial connector;

a connector interface device, whereby the connector interface device is provided in a cavity in the coaxial connector, the connector interface device comprising:

a first center conductor pin;

an outer conductor insert with a cylindrical first end and a second end, with the cylindrical first end including a first bore, and a first counter bore in the first bore;

a glass bead located within the first counter bore of the outer conductor, such that the glass bead supports the first center conductor pin, whereby the glass bead is hermetically sealed by solder applied between the glass bead and the outer conductor; and a ground lip for forming an extension from the coaxial connector, the ground lip extending from the second end of the outer conductor insert and forming a half cylinder, the ground lip supporting the carrier to provide a ground path for a microstrip substrate mounted on the carrier, the ground lip for extending into the opening in the housing and making electrical contact with the housing.

2. A connector assembly according to claim 1, whereby the coaxial connector comprises:

an outer conductor including the cavity for supporting the connector interface device, and a center bore; and a second center conductor pin for mating with the first center conductor pin provided in the center bore of the outer conductor.

3. A connector assembly according to claim 2, whereby the second center conductor pin has a first diameter and a second diameter to provide for impedance matching to a diameter of the first center conductor pin.

4. A connector assembly according to claim 1, whereby the opening in the housing for insertion of the coaxial connector includes an alignment fixture to insure a correct orientation of the ground lip when the connector is inserted into the housing.

5. The connector assembly according to claim 1, wherein the glass bead does not extend beyond the first counterbore into the first bore toward the second end of the outer conductor.

6. The connector assembly according to claim 1, wherein the microstrip substrate is attached to the housing by a carrier, and a gap extends between the ground lip and the carrier.

* * * * *